US009168522B2

(12) United States Patent
Saito et al.

(10) Patent No.: US 9,168,522 B2
(45) Date of Patent: Oct. 27, 2015

(54) PIPETTE

(75) Inventors: Shingo Saito, Tokyo (JP); Yasutaka Yuki, Tochigi (JP); Yoshiharu Ichikawa, Tochigi (JP)

(73) Assignee: EIKEN KAGAKU KABUSHIKI KAISHA, Tokyo (JP)

( * ) Notice: Subject to any disclaimer, the term of this patent is extended or adjusted under 35 U.S.C. 154(b) by 450 days.

(21) Appl. No.: 13/698,139

(22) PCT Filed: May 26, 2011

(86) PCT No.: PCT/JP2011/002948

§ 371 (c)(1),
(2), (4) Date: Nov. 15, 2012

(87) PCT Pub. No.: WO2011/148643

PCT Pub. Date: Dec. 1, 2011

(65) Prior Publication Data

US 2013/0061694 A1 Mar. 14, 2013

(30) Foreign Application Priority Data

May 28, 2010 (WO) ..... PCT/JP2010/003607

(51) Int. Cl.
*B01L 3/02* (2006.01)

(52) U.S. Cl.
CPC ..... *B01L 3/0279* (2013.01); *B01L 3/0224* (2013.01); *B01L 2200/141* (2013.01)

(58) Field of Classification Search
CPC B01L 3/0224; B01L 3/0279; B01L 2200/141
USPC ..... 73/864.14, 864.16, 864.18; 422/516, 422/522, 525, 923, 925, 931–932, FOR. 108
See application file for complete search history.

(56) References Cited

U.S. PATENT DOCUMENTS 3,640,434 A * 2/1972 Walker ..... 73/864.18 X
3,834,240 A * 9/1974 Kenney ..... 73/864.15

(Continued)

FOREIGN PATENT DOCUMENTS

FR 2917648 A1 * 12/2008 ..... B01L 3/02
GB 2029723 A * 3/1980 ..... B01L 3/02

(Continued)

OTHER PUBLICATIONS

English Translation of the Written Opinion of the International searching Authority for PCT/JP2010/003607 mailed Aug. 31, 2010.*

(Continued)

*Primary Examiner* — Thomas P Noland
(74) *Attorney, Agent, or Firm* — Wenderoth, Lind & Ponack, L.L.P.

(57) ABSTRACT

A pipette includes a cylinder having a distal end portion to which a pipette tip is removably fitted; and a piston fitted to be freely advanced and retreated in a cylinder chamber. The piston is retreated to suck liquid and advanced to eject the liquid thus sucked. The piston includes, on an outer periphery thereof, a communication groove for allowing an inside of the cylinder chamber to communicate with an outside of the cylinder chamber when the piston is advanced by an amount corresponding to a dimension larger than a predetermined dimension. The communication groove is located on the outside of the cylinder chamber when the piston is located at a retreated position. When the piston is advanced by the amount corresponding to the dimension larger than the predetermined dimension, a seal between the cylinder chamber and the piston is released so that pressure in the cylinder chamber becomes equal to the atmospheric pressure, and a suction/ejection effect is eliminated.

14 Claims, 9 Drawing Sheets

(56) References Cited

U.S. PATENT DOCUMENTS

| | | | | |
|---|---|---|---|---|
| 4,852,620 | A | 8/1989 | Jakubowicz et al. | |
| 5,435,197 | A * | 7/1995 | Telimaa et al. | 73/864.14 |
| 6,199,435 | B1 * | 3/2001 | Wilmer et al. | 73/864.14 |
| 6,874,379 | B2 | 4/2005 | Matsuda et al. | |
| 8,117,927 | B2 * | 2/2012 | Millet et al. | 73/864.16 X |
| 2002/0031768 | A1 * | 3/2002 | McMillan et al. | 435/6 |
| 2005/0155439 | A1 * | 7/2005 | Belgardt | 3/279 |
| 2005/0175511 | A1 | 8/2005 | Cote et al. | |
| 2006/0263261 | A1 * | 11/2006 | Lenz | 3/279 |
| 2007/0169571 | A1 * | 7/2007 | May et al. | 73/864.16 X |
| 2008/0286151 | A1 * | 11/2008 | Chang et al. | 422/68.1 |
| 2009/0280033 | A1 | 11/2009 | Cote et al. | |

FOREIGN PATENT DOCUMENTS

| | | | | |
|---|---|---|---|---|
| JP | 2-164457 | 6/1990 | | |
| JP | 6-23283 | 2/1994 | | |
| JP | 2002-62304 | 2/2002 | | |
| JP | 2007-521956 | 8/2007 | | |
| KR | 101324887 | B1 * | 11/2013 | B01L 3/02 |
| WO | WO 2010126386 | A1 * | 11/2010 | B01L 3/02 |
| WO | WO 2011148432 | A1 * | 12/2011 | B01L 3/02 |

OTHER PUBLICATIONS

English Translation of the Written Opinion of the International searching Authority for PCT/JP2011/002948 mailed Aug. 9, 2011.*

International Search Report issued Aug. 9, 2011 in International (PCT) Application No. PCT/JP2011/002948.

* cited by examiner

PIPETTE

TECHNICAL FIELD

The present invention relates to a pipette in which a piston is advanced and retreated in a cylinder having a distal end portion to which a pipette tip is removably fitted so that liquid is sucked into the pipette tip and the liquid thus sucked is ejected.

BACKGROUND ART

For example, as a pipette used for dispensing liquid such as blood and liquid medicine, there has been known what is called a disposable pipette in which a pipette tip removably fitted thereto is disposed of after use in order to prevent cross contamination among liquids.

There has been a demand that quantitative operations using such a pipette at the time of suction and ejection of liquids be safely performed in order to prevent an inside of a cylinder from being contaminated by liquids, scattering of the liquids, and infection to pipette operators and contamination of inspection environments when, for example, the liquids are infectious samples. Further, it is desired that the pipette tip containing sucked liquid be disposed of by being separated from the pipette without being touched by hand after ejection of the liquid.

Conventionally, as a pipette of this type, there has been proposed a pipette including, as means for determining a suction/ejection amount of liquid based on an advancement/retreat amount of the piston and separating the pipette tip from the pipette so that the pipette tip is disposed of, a pipette tip separation mechanism including a sleeve movably fitted to an outer periphery of a cylinder, and an operating portion including an operation lever, an arm, gears, and a spring, in which the sleeve is pushed down by an operation of the operating portion so that the sleeve abuts against the pipette tip, thereby separating the pipette tip from a distal end of the cylinder (refer, for example, to Patent Literature 1).

CITATION LIST

Patent Literature

[PTL 1] JP 3470150 B

As described above, similarly to the pipette described in Patent Literature 1, the pipette of this type generally determines the suction/ejection amount of liquid based on the advancement/retreat amount of the piston. Thus, in a case where a pipette operator mistakenly performs such an operation that the piston is advanced or retreated by an amount corresponding to a dimension larger than a predetermined dimension, at the time of suction of liquid, an amount of liquid to be sucked may exceed a capacity of the pipette tip, with the result that the liquid may intrude into the cylinder and contaminate an inside of the cylinder. Meanwhile, at the time of ejection of the liquid, the liquid may be scattered. For those reasons, the pipette operator needs to be highly skilled and to pay utmost attention during the operation of the piston.

Further, quantitative operations need to be performed at the time of suction and ejection of liquids. In addition, as means for separating the pipette tip from the pipette and disposing of the pipette tip without being touched by hand after the liquid sucked in the pipette tip is ejected therefrom, the pipette described in Patent Literature 1 is provided with the independent pipette tip separation mechanism. Therefore, there arise problems of a structural complexity and an increase in cost.

SUMMARY OF THE INVENTION

It is therefore an object of the present invention to provide a pipette which enables any person to easily, reliably, and safely perform the quantitative operations at the time of suction and ejection of liquid by a simple operation without requirement of high skill.

It is another object of the present invention to provide a pipette capable of preventing intrusion of liquid into a cylinder chamber.

It is still another object of the present invention to provide a pipette capable of adjusting a liquid suction amount.

It is yet another object of the present invention to provide a pipette which enables suction and ejection of liquid and separation of the pipette tip to be performed respectively by a series of operations.

It is yet another object of the present invention to provide a pipette capable of preventing liquid left in the pipette tip from scattering at the time of ejection of liquid or separation of the pipette tip from the cylinder.

It is yet another object of the present invention to provide a pipette capable of preventing fingers of a pipette operator or gloves worn by the pipette operator from being nipped or caught in at the time of separation of the pipette tip from the cylinder.

It is yet another object of the present invention to provide a pipette which has a simple structure and can be obtained at low cost.

Solution to Problems

In order to achieve the above-mentioned objects, the invention provides a pipette, including: a cylinder having a distal end portion to which a pipette tip is removably fitted; and a piston fitted to be freely advanced and retreated in a cylinder chamber, the piston being retreated to suck liquid and advanced to eject the liquid thus sucked. The piston includes, on an outer periphery thereof, a communication groove for communicating an inside of the cylinder chamber and an outside of the cylinder chamber to each other when the piston is advanced by an amount corresponding to a dimension larger than a predetermined dimension, the communication groove being located on the outside of the cylinder chamber when the piston is located at a retreated position.

Also according to an aspect of the invention, an amount of liquid sucked in accordance with movement of the piston is set to be smaller than a capacity for the liquid in the pipette tip, the movement including retreat of the piston to the retreated position after advancement of the piston from the retreated position by an amount corresponding to the predetermined dimension.

According to a further aspect of the invention, the pipette further includes position confirmation means for notifying that the piston has been advanced by the amount corresponding to the predetermined dimension.

According to another aspect of the invention, the pipette further includes liquid suction amount adjusting means for adjusting the retreated position of the piston.

According to another aspect of the invention, the pipette further includes: a release tube fitted to an outer periphery of the cylinder so as to be freely movable in an axial direction, the release tube being capable of abutting against the pipette tip fitted to the distal end portion of the cylinder by being moved in a distal end direction; and a release portion which is provided to an operating portion for operating the piston and moved integrally with the piston. After the piston is advanced by the amount corresponding to the dimension larger than the predetermined dimension, the release portion abuts against the release tube so that the release tube is moved in the distal end direction, to thereby push off the pipette tip, which is fitted to the distal end portion of the cylinder, from the cylinder through intermediation of the release tube.

According to a further aspect of the invention, the pipette further includes a flange portion formed at a proximal end of the release tube so that the release portion abuts against the flange portion. The flange portion includes a cylindrical guard portion for surrounding the release portion.

According to a further aspect of the invention, the piston, the operating portion, and the release portion are integrated with one another.

Advantageous Effects of Invention

On the outer periphery of the piston, the communication groove allows the inside of the cylinder chamber and the outside of the cylinder chamber to communicate with each other when the piston is advanced by the amount corresponding to the dimension larger than the predetermined dimension. The communication groove is located on the outside of the cylinder chamber when the piston is located at the retreated position. Thus, when the communication groove of the piston advanced into the cylinder chamber reaches the cylinder chamber, the communication groove releases the seal between the cylinder chamber and the piston, with the result that the inside of the cylinder chamber and the outside of the cylinder chamber are communicated to each other. With this, pressure in the cylinder chamber becomes equal to the atmospheric pressure, and a suction/ejection effect is eliminated. In this way, a maximum amount of the liquid sucked and ejected by retreat and advancement of the piston is restricted by a dimension between a distal end of the piston and the communication groove. Thus, even when the piston is advanced by the amount corresponding to the dimension larger than the predetermined dimension, the liquid can be reliably prevented from being sucked or ejected by a predetermined amount or larger. Thus, the quantitative operations at the time of suction and ejection of the liquid can be easily, reliably, and safely performed by any person by a simple operation without requirement of high skill.

Further, the quantitative operations at the time of suction and ejection of the liquid can be reliably performed, and hence the liquid can be prevented from intruding into the cylinder chamber and from scattering at the time of ejection of the liquid.

The amount of liquid sucked in accordance with the movement of the piston can be set to be smaller than the capacity for the liquid in the pipette tip, the movement including the retreat of the piston to the retreated position after the advancement of the piston from the retreated position by the amount corresponding to the predetermined dimension. Thus, at the time of suction of the liquid, the liquid can be prevented from intruding into the cylinder chamber, and hence the inside of the cylinder chamber can be prevented from being contaminated by the liquid.

The pipette can also include a position confirmation means for notifying that the piston has been advanced by the amount corresponding to the predetermined dimension. Thus, a piston operator can be notified that the piston has been advanced by the amount corresponding to the predetermined dimension, which facilitates quantitative suction of the liquid.

The pipette can also include the liquid suction amount adjusting means for adjusting the retreated position of the piston. Thus, a liquid suction amount can be easily and reliably adjusted.

At the time of separation of a pipette tip after use, when the piston is advanced by the amount corresponding to the dimension larger than the predetermined dimension, the release portion provided to the piston abuts against the release tube so that the release tube is pushed and moved in the distal end direction. As a result, the release tube pushed and moved by the release portion pushes off, from the cylinder, the pipette tip fitted to the distal end portion of the cylinder. In this way, the pipette tip can be separated from the distal end portion of the cylinder.

This operation for separating the pipette tip can be performed only by a series of strokes of the piston similar to those in the operations of sucking and ejecting liquid, and hence can be easily performed. In addition, the same components can be utilized for the structure for sucking and ejecting liquid and the structure for separating the pipette tip because this operation can be performed by a series of operations similar to those in the suction and ejection of liquid. Therefore, the number of components can be saved, and hence the pipette can be easily manufactured and obtained at low cost.

Further, the piston includes, on the outer periphery thereof, the communication groove for communicating the inside of the cylinder chamber and the outside of the cylinder chamber to each other when the piston is advanced by the amount corresponding to the dimension larger than the predetermined dimension, the communication groove being located on the outside of the cylinder chamber when the piston is located at the retreated position. Thus, when the piston is advanced by the amount corresponding to the dimension larger than the predetermined dimension so that the pipette tip fitted to the distal end portion of the cylinder is pushed off from the cylinder by pressing and moving the release tube in the distal end direction, the communication groove releases the seal between the cylinder chamber and the piston, with the result that the pressure in the cylinder chamber becomes equal to the atmospheric pressure. Thus, even when liquid is left in the pipette tip, a situation in which the liquid scatters at the time of separating the pipette tip can be prevented.

The pipette can further include the flange portion formed at the proximal end of the release tube so that the release portion abuts against the flange portion, and the flange portion includes the cylindrical guard portion for surrounding the release portion. Thus, at the time of separating the pipette tip from the cylinder, fingers of a pipette operator or gloves worn by the pipette operator can be prevented from being nipped or caught in between the release portion and the flange portion formed at the proximal end of the release tube.

Furthermore, the piston, the operating portion, and the release portion can be integrated with one another. Thus, the number of components can be saved, and a structure can be simplified. As a result, the pipette can be easily manufactured and obtained at low cost.

DESCRIPTION OF EMBODIMENT

Figure 1:
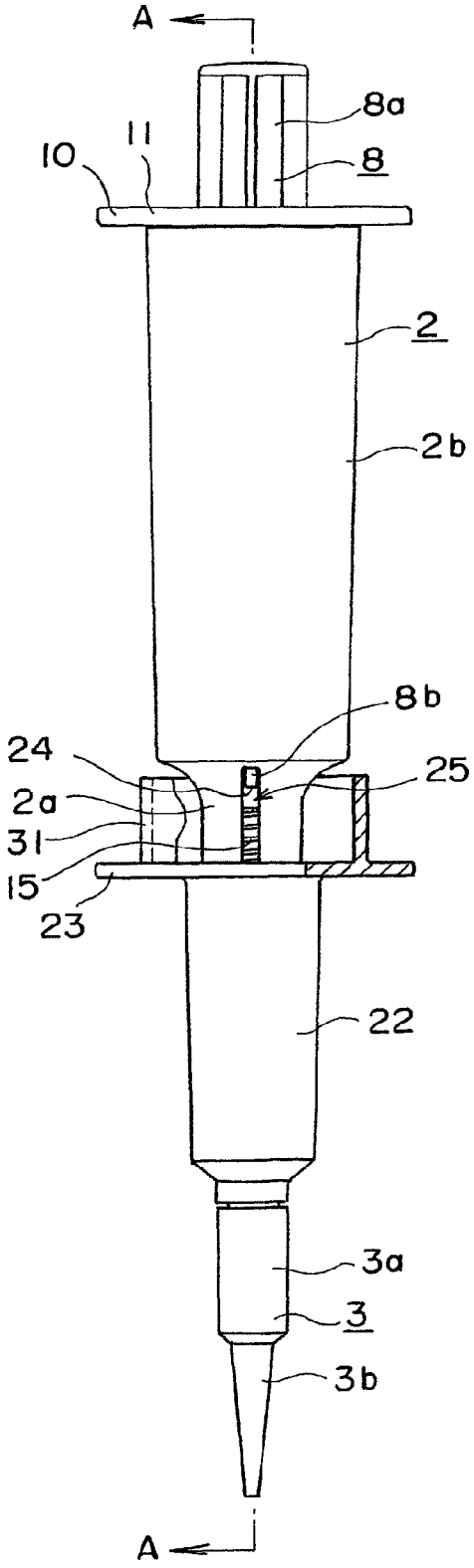
FIG. 1 A partially cutaway front view illustrating an example of a pipette according to an embodiment of the present invention.
Figure 2:
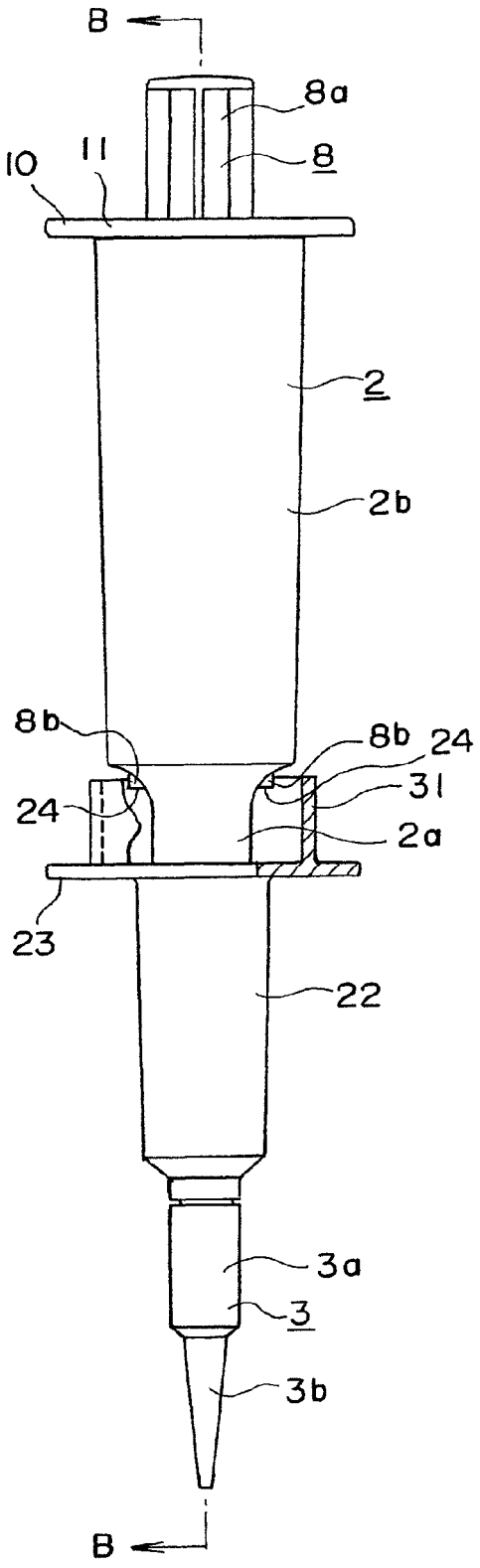
FIG. 2 A partially cutaway side view of FIG. 1.
Figure 3:
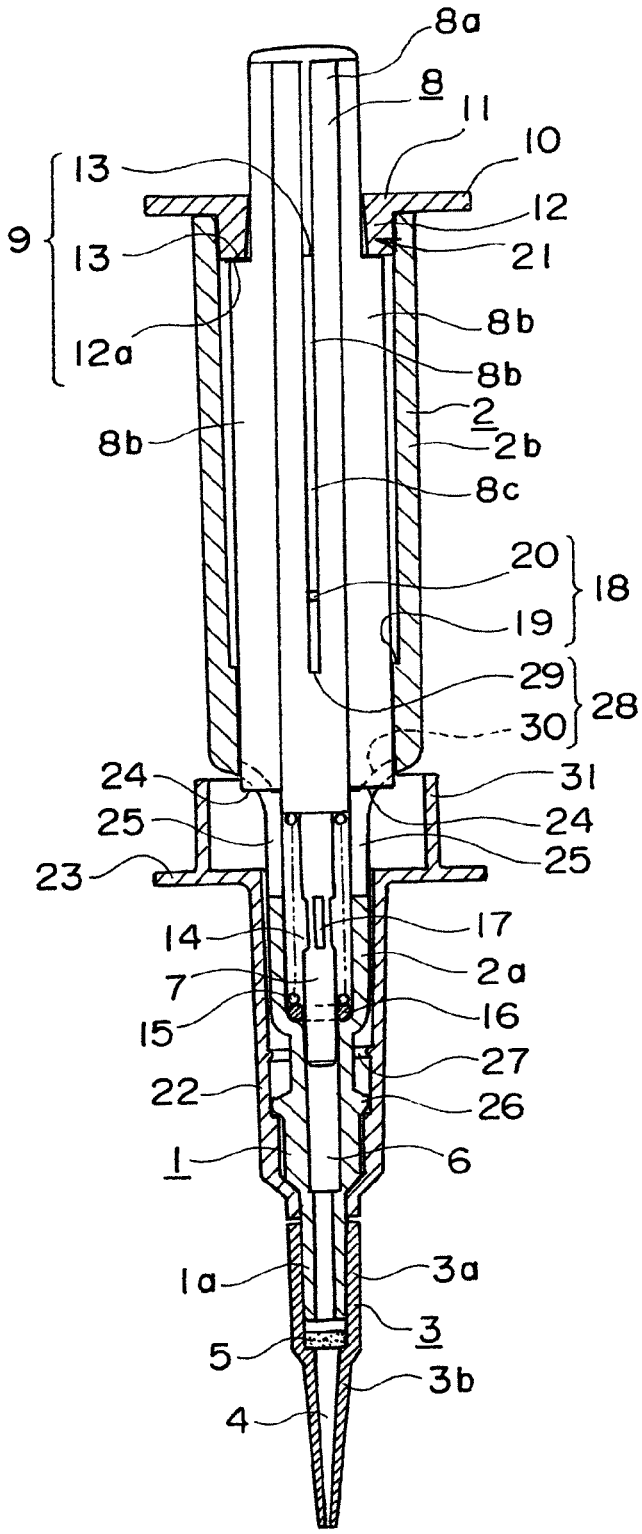
FIG. 3 A sectional view taken along the line A-A of FIG. 1.
Figure 4:
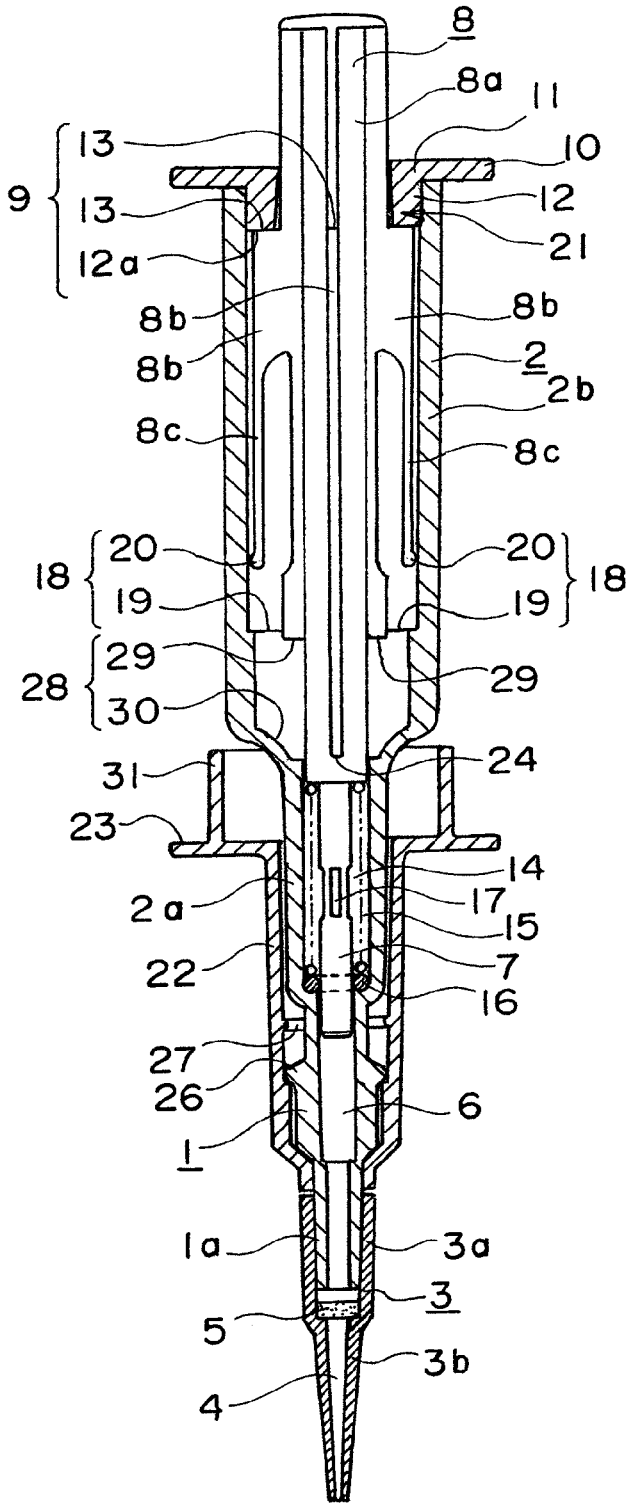
FIG. 4 A sectional view taken along the line B-B of FIG. 2.

In the following, detailed description is made of a pipette according to one embodiment of the present invention with reference to the drawings.

A cylinder 1 of the pipette according to this embodiment has a proximal end provided integrally with a cylindrical cylinder holder 2 coaxial with the cylinder 1. Further, a proximal portion 3*a* of a pipette tip 3 is removably fitted to a distal end portion 1*a* of the cylinder 1 by friction fit. An inside of a distal end portion 3*b* of the pipette tip 3 fitted to the distal end portion 1*a* of the cylinder 1 serves as a liquid containing portion 4. The liquid containing portion 4 is partitioned from the proximal portion 3*a* by a built-in filter 5.

Further, the cylinder holder 2 provided integrally with the proximal end of the cylinder 1 includes, on a distal end side thereof, a small diameter cylindrical portion 2*a* having substantially the same diameter as that of the proximal end of the cylinder 1, and includes, on a proximal end side thereof, a large diameter cylindrical portion 2*b*.

Further, a piston 7 is fitted to be freely advanced and retreated in a cylinder chamber 6 formed in the cylinder 1. With this, when the piston 7 is retreated in the cylinder chamber 6, liquid is sucked into the pipette tip 3 fitted to the distal end portion 1*a* of the cylinder 1, and when the piston 7 is advanced in the cylinder chamber 6, the liquid thus sucked is ejected from the pipette tip 3. A bar-like operating portion 8 which is operated to advance and retreat the piston 7 is provided coaxially and integrally with a proximal end of the piston 7. The operating portion 8 is freely movable in an axial direction through the cylinder holder 2, and includes a proximal portion 8*a* projected from a proximal end of the cylinder holder 2 to an outside.

On an inner periphery of the proximal end of the cylinder holder 2, there is provided retreated position setting means 9 for determining a retreated position of the piston 7. In this embodiment, as the retreated position setting means 9, a cylindrical plug body 11 which allows the operating portion 8 to be freely movable therethrough and has an outer periphery provided with a flange portion 10 is fixed by fitting to the inner periphery of the proximal end of the cylinder holder 2. Further, engagement portions 13 engageable with an end portion 12*a* of a cylindrical portion 12 fitted to an inside of the cylinder holder 2 are provided on an outer peripheral surface of the operating portion 8. With this, a position at which the engagement portions 13 of the operating portion 8 to be retreated are engaged with the end portion 12*a* of the cylindrical portion 12 fitted to the inside of the cylinder holder 2 is set as a retreated position of the operating portion 8.

In this embodiment, the engagement portions 13 are formed of respective end portions on a proximal end side of a plurality of plate-like portions 8*b* radially provided on an outer periphery and in a lengthwise direction of the operating portion 8.

Further, an inside of the small diameter cylindrical portion 2*a* of the cylinder holder 2 communicating to the cylinder chamber 6 formed in the cylinder 1 serves as a spring chamber 14. The spring chamber 14 has an inner diameter larger than a diameter of the cylinder chamber 6. The operating portion 8 provided at the proximal end of the piston 7 has a diameter substantially equal to the inner diameter of the spring chamber 14 so that the operating portion 8 can be inserted into the spring chamber 14.

The spring chamber 14 incorporates a spring 15 for urging the operating portion 8 toward the proximal end side of the cylinder holder 2. In other words, in a retreated direction of the piston 7, the spring 15 has one end engaged with a boundary step portion between the cylinder chamber 6 and the spring chamber 14 and another end engaged with a step portion formed between the piston 7 and the operating portion 8.

Further, a seal ring 16 for sealing a region between the cylinder chamber 6 and the piston 7 is slidably fitted on an outside of the cylinder chamber 6 with respect to the piston 7 fitted to be freely advanced and retreated in the cylinder chamber 6. In other words, the seal ring 16 is fitted to an outer periphery of the piston 7 located on the spring chamber 14 side. The seal ring 16 is constantly pressed by the above-mentioned one end of the spring 15 onto the boundary step portion between the cylinder chamber 6 and the spring chamber 14 so as to seal the region surrounded by the piston 7, the cylinder chamber 6, and the spring chamber 14.

On the outer periphery of the piston 7 to be advanced and retreated by an operation of the operating portion 8, there are provided communication grooves 17 for communicating the inside and the outside of the cylinder chamber 6 to each other, in other words, the cylinder chamber 6 and the spring chamber 14 to each other when the piston 7 is advanced by an amount corresponding to a dimension larger than a predetermined dimension, the communication grooves 17 located on the outside of the cylinder chamber 6 when the piston 7 is located at the retreated position. The communication grooves 17 are each formed of a longitudinal groove extending in the axial direction. Thus, when the piston 7 is advanced by the amount corresponding to the dimension larger than the predetermined dimension, the communication grooves 17 are located over the cylinder chamber 6 and the spring chamber 14 when the seal ring 16 is located around the communication grooves 17. In this way, the communication grooves 17 release the seal between the cylinder chamber 6 and the piston 7, with the result that the inside and the outside of the cylinder chamber 6 can communicate with each other.

The predetermined dimension herein refers to a movement amount which restricts an upper limit of an amount of suction into the cylinder chamber 6, the suction being performed by moving the piston 7, specifically, advancing the piston 7 at the retreated position to a predetermined position and then restoring the piston 7 from the advanced position to the retreated position. In other words, a maximum liquid suction amount is set by the predetermined dimension, and it is necessary to set the suction amount in this case to be smaller than a capacity of the liquid containing portion 4 in the pipette tip 3.

Further, in this embodiment, there is provided position confirmation means 18 for notifying that the piston 7 has been advanced by the amount corresponding to the predetermined dimension. The position confirmation means 18 in this embodiment includes a projecting step portion 19 formed at a position apart by the predetermined dimension in an advancing direction from the retreated position of the piston 7 on an inner peripheral surface of the large diameter cylindrical portion 2*b* of the cylinder holder 2, and abutment portions 20 which are provided to the operating portion 8 and abut against the projecting step portion 19 when the piston 7 is advanced from the retreated position by the amount corresponding to the predetermined dimension. With this, when the piston 7 is advanced, a piston operator feels resistance generated by abutment of the abutment portions 20 of the operating portion 8 against the projecting step portion 19. In this way, it can be confirmed that the piston 7 has been advanced by the amount corresponding to the predetermined dimension. The abutment portions 20 provided to the operating portion 8 each have elasticity, and hence are elastically deformed to climb over the projecting step portion 19 so that the piston 7 can be further advanced.

In this embodiment, the abutment portions 20 provided to the operating portion 8 each include a swelling portion formed at a distal end of a flexible longitudinal piece 8*c* obtained by utilizing a part of each of the plurality of plate-like portions 8*b* provided to the operating portion 8, specifically, forming a longitudinal groove from the distal end side to the proximal end side along an outer edge of each of the plate-like portions 8*b*.

Still further, in this embodiment, there is provided liquid suction amount adjusting means 21 for adjusting the retreated position of the piston 7. In this embodiment, the plug body 11 serving as the retreated position setting means 9 is utilized as the liquid suction amount adjusting means 21. In addition, the plug body 11 includes a plurality of plug bodies 11 different in length of the cylindrical portion 12 so that the plurality of plug bodies 11 thus prepared are utilized as the liquid suction amount adjusting means 21.

The retreated position of the piston 7 is determined by the length of the cylindrical portion 12 of the plug body 11. Thus, when the plug bodies 11 are replaced to change the length of the cylindrical portion 12, a stroke amount of the piston 7 can be changed in accordance therewith. Therefore, a liquid suction amount can be adjusted. When the plurality of plug bodies 11 different in length of the cylindrical portion 12 are prepared, the retreated position of the piston varies. The above-mentioned "predetermined dimension" is set based on a farthest retreated position of the piston. Therefore, the farthest retreated position of the piston is set by a plug body 11 including a shortest cylindrical portion 12, and hence the predetermined dimension is set based on a retreated position at the time of using the plug body 11 having the shortest cylindrical portion 12.

Figure 5:
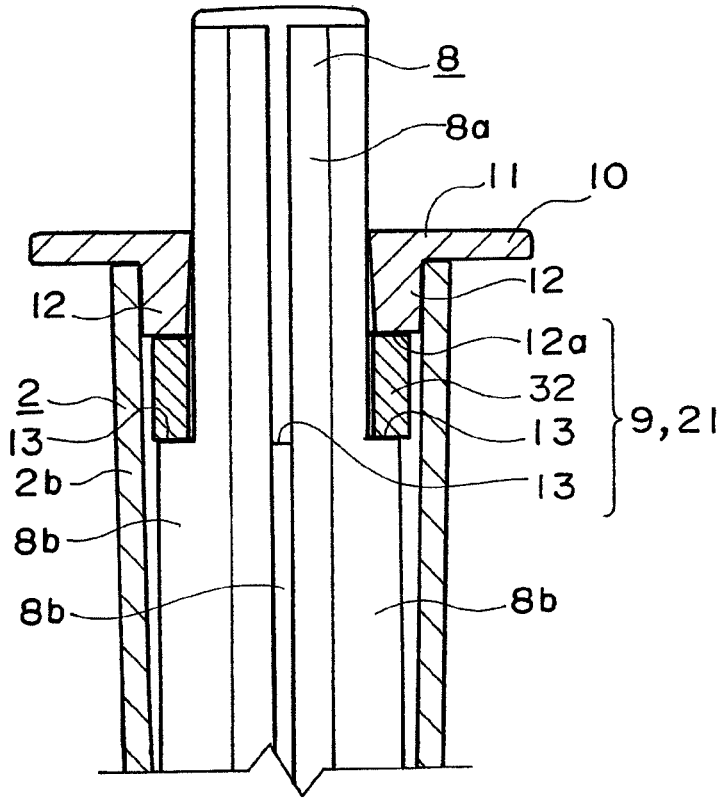
FIG. 5 A main-part sectional view illustrating another example of liquid suction amount adjusting means.

As illustrated in FIG. 5, as another example of the liquid suction amount adjusting means 21, an auxiliary cylinder 32 for adjusting a clearance between the end portion 12*a* and the engagement portions 13 may be interposed between the end portion 12*a* of the cylindrical portion 12 of the plug body 11 and the engagement portions 13 of the operating portion 8. The auxiliary cylinder 32 is formed to have an outer diameter smaller than an inner diameter of the cylinder holder 2 and an inner diameter larger than an outer diameter of the operating portion 8, and fitted to be freely movable on the proximal portion 8*a* side of the operating portion 8 in the cylinder holder 2. The auxiliary cylinder 32 has one end engageable with the engagement portions 13 of the operating portion 8 and another end engageable with the end portion 12*a* of the cylindrical portion 12 of the plug body 11. When the auxiliary cylinder 32 thus formed includes a plurality of auxiliary cylinders 32 different in length of the cylinder so that the length of the cylinder is changed by replacing the plurality of auxiliary cylinders 32 thus prepared, the stroke amount of the piston 7 can be changed. Therefore, the liquid suction amount can be adjusted.

Further, although not shown, the retreated position setting means 9 for determining the retreated position of the piston 7 is provided on the inner periphery of the proximal end of the cylinder holder 2. In this embodiment, as the retreated position setting means 9, a female thread is formed along the inner periphery of the proximal end of the cylinder holder 2 while a male thread is formed along an outer periphery of the cylindrical portion 12 of the plug body 11 so that the cylindrical portion 12 of the plug body 11 is threadedly engaged with the inner periphery of the proximal end of the cylinder holder 2. With this structure, a screw-in amount of the cylindrical portion 12 of the plug body 11 with respect to the cylinder holder 2 can be adjusted, and hence the length of the cylindrical portion 12 of the plug body 11 in the cylinder holder 2 can be changed.

Still further, although not shown, the operating portion 8 including the engagement portions 13 engageable with the end portion 12*a* of the cylindrical portion 12 fitted to the inside of the cylinder holder 2 may be utilized as the liquid suction amount adjusting means 21. Specifically, the operating portion 8 may include a plurality of operating portions 8 different in position of the engagement portions 13 in the lengthwise direction. Also with this, the stroke amount of the piston 7 can be changed.

A release tube 22 is fitted to an outer periphery of the above-mentioned cylinder 1 so as to be freely movable in the axial direction in a manner that the release tube 22 surrounds the cylinder 1 and the small diameter cylindrical portion 2*a* of the cylinder holder 2. When the release tube 22 is moved to the distal end side, a distal end of the release tube 22 abuts against a proximal end of the pipette tip 3 fitted to the distal end portion 1*a* of the cylinder 1 so that the pipette tip 3 is pushed off from the distal end portion 1*a* of the cylinder 1. A flange portion 23 is formed on an outer periphery of a proximal end of the release tube 22.

Further, release portions 24 to be moved integrally with the piston 7 are provided to the operating portion 8 for operating the piston 7. Guide grooves 25 are provided in the cylinder holder 2 to extend in the axial direction toward the small diameter cylindrical portion 2*a* side from a boundary between the small diameter cylindrical portion 2*a* and the large diameter cylindrical portion 2*b*. The release portions 24 provided to the operating portion 8 are projected through the guide grooves 25 toward the outside of the cylinder holder 2 and move along the guide grooves 25 along with movement of the piston 7. After the piston 7 is advanced by the amount corresponding to the dimension larger than the predetermined dimension, the release portions 24 provided to the operating portion 8 abut against the flange portion 23 at the proximal end of the release tube 22 so that the release tube 22 is pushed off to the distal end side.

In this case, in order to prevent the release tube 22 pushed by the release portions 24 from dropping off from the cylinder 1, on an outer peripheral surface of the cylinder 1 and an inner peripheral surface of the release tube 22, there are respectively formed annular projecting portions 26 and 27 to be engaged with each other.

The release portions 24 provided to the operating portion 8 are provided integrally with the operating portion 8. In this embodiment, of the plurality of plate-like portions 8*b* provided to the operating portion 8, end portions on a distal end side of the plate-like portions 8*b* other than the plate-like portions 8*b* utilized as the abutment portions 20 are utilized as the release portions 24.

Further, in this embodiment, there is provided advancement restricting means 28 for restricting further advancement of the release portions 24 provided to the operating portion 8 after the release portions 24 abut against the flange portion 23 at the proximal end of the release tube 22 so that the release tube 22 is pushed off to the distal end side.

In this embodiment, the advancement restricting means 28 includes engagement portions 29 provided to the outer periphery of the operating portion 8 so that, at a position at which the release portions 24 push off the release tube 22 to the distal end side, the engagement portions 29 are engaged with a boundary step portion 30 between the small diameter cylindrical portion 2*a* and the large diameter cylindrical portion 2*b* of the cylinder holder 2. With this structure, further advancement of the piston 7 is prevented.

In this embodiment, with regard to the engagement portions 29 provided to the operating portion 8, of the plurality of plate-like portions 8*b* provided to the operating portion 8, end portions on a distal end side of the plate-like portions 8*b* utilized as the abutment portions 20 are utilized as the engagement portions 29.

Further, in this embodiment, the flange portion 23 formed at the proximal end of the release tube 22 is provided with a cylindrical guard portion 31 for surrounding the release portions 24 which are projected through the guide grooves 25 toward the outside of the cylinder holder 2 and move along the guide grooves 25 along with the movement of the piston 7.

In an unused state of the pipette structured as described above, the piston 7 is located at the retreated position under urging by the spring 15. At the time of use, the distal end portion of the pipette tip 3 fitted to the distal end portion 1*a* of the cylinder 1 is inserted into liquid to be collected. Then, the proximal portion 8*a* of the operating portion 8 projected from the proximal end of the cylinder holder 2 to the outside is pushed against a resilient force of the spring 15 into the distal end side.

When the push-in operation for the operating portion 8 is stopped after the piston 7 is advanced, the resilient force of the spring 15 causes the piston 7 to be restored to the retreated position. In accordance therewith, a suction effect by the piston 7 causes the liquid to be sucked into the pipette tip 3 fitted to the distal end portion 1*a* of the cylinder 1 and to be contained into the liquid containing portion 4. In this case, an amount of liquid sucked in accordance with the movement of the piston 7, specifically, retreat of the piston 7 to the retreated position after advancement of the piston 7 from the retreated position by the amount corresponding to the predetermined dimension, is set to be smaller than the capacity of the liquid containing portion 4. Thus, when the liquid is sucked, the liquid can be prevented from intruding into the cylinder chamber 6.

It is desired that the advancement amount of the piston 7 do not exceed the preset predetermined dimension. In this embodiment, the position confirmation means 18 for notifying that the piston 7 has been advanced by the amount corresponding to the predetermined dimension is provided. With this, a piston operator can be notified that the piston 7 has been advanced by the amount corresponding to the predetermined dimension, which facilitates quantitative suction and ejection of the liquid.

In this embodiment, the position confirmation means 18 transmits, to the piston operator, the resistance generated by abutment of the abutment portions 20 provided to the operating portion 8 against the projecting step portion 19 formed on the inner peripheral surface of the large diameter cylindrical portion 2*b* of the cylinder holder 2 so that the piston operator can confirm that the piston 7 has been advanced by the amount corresponding to the predetermined dimension. Thus, the piston operator can be reliably notified that the piston 7 has been advanced by the amount corresponding to the predetermined dimension.

Even when the piston 7 is advanced by the amount corresponding to the dimension larger than the predetermined dimension, a suction/ejection effect is eliminated. This is because pressure in the cylinder chamber 6 becomes equal to the atmospheric pressure by the communication grooves 17 provided on the outer periphery of the piston 7 so that the inside and the outside of the cylinder chamber 6 are communicated to each other when the piston 7 is advanced by the amount corresponding to the dimension larger than the predetermined dimension. With this, a maximum amount of the liquid sucked and ejected by retreat and advancement of the piston 7 is restricted by a dimension between a distal end of the piston 7 and the communication grooves 17. Thus, even when the piston 7 is advanced by the amount corresponding to the dimension larger than the predetermined dimension, the liquid can be reliably prevented from being sucked or ejected by a predetermined amount or larger.

Figure 6:
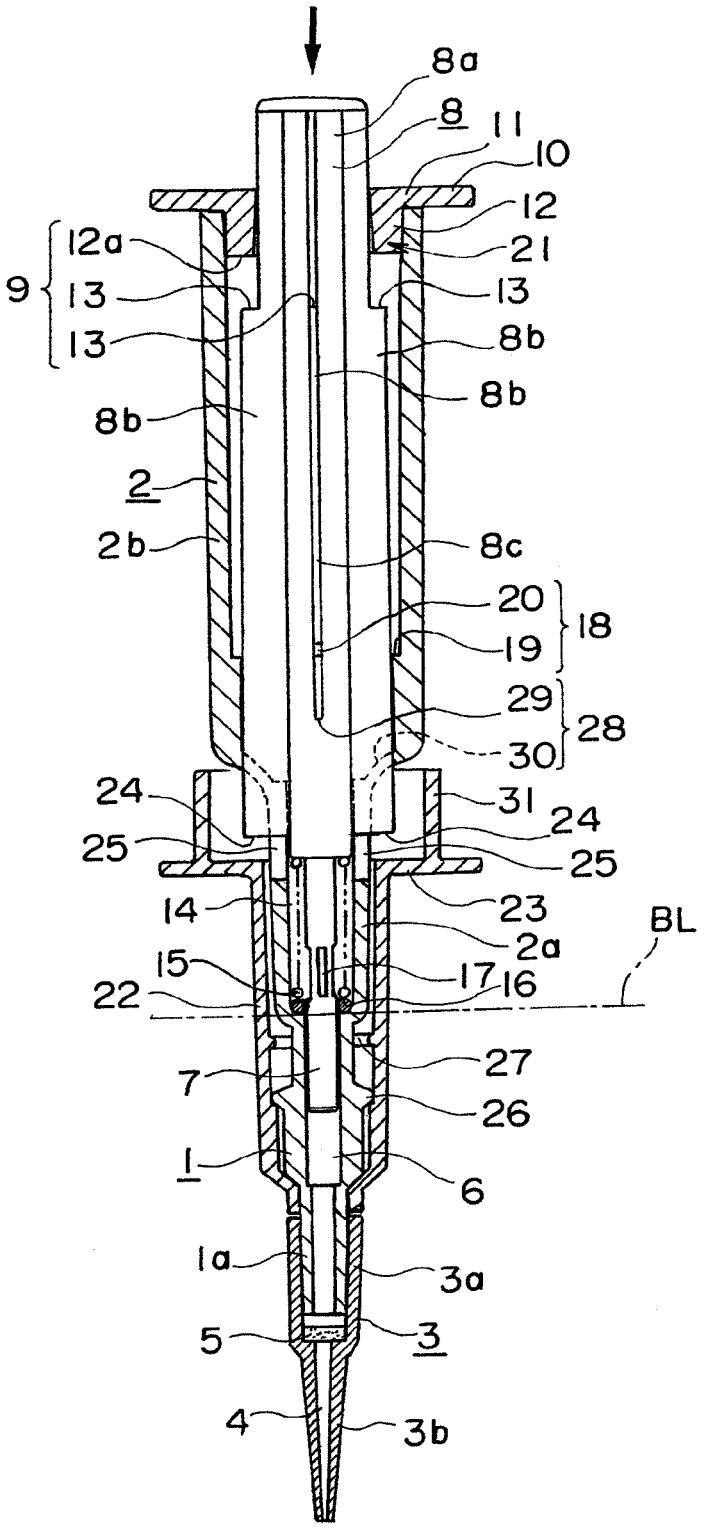
FIG. 6 An explanatory sectional view of a state in which a piston is advanced by an amount corresponding to a predetermined dimension.
Figure 7:
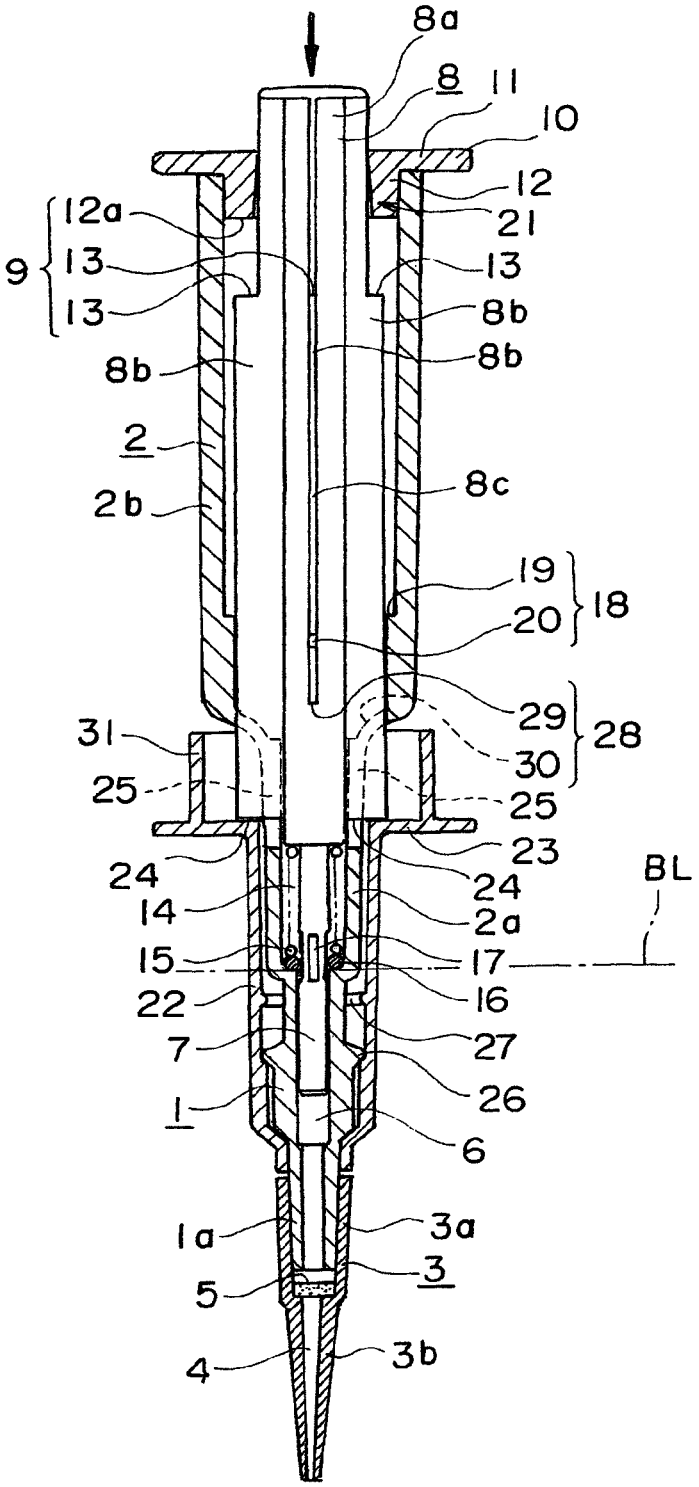
FIG. 7 An explanatory sectional view of a state in which an inside and an outside of a cylinder are communicated to each other along with advancement of the piston by an amount corresponding to a dimension larger than the predetermined dimension.
Figure 8:
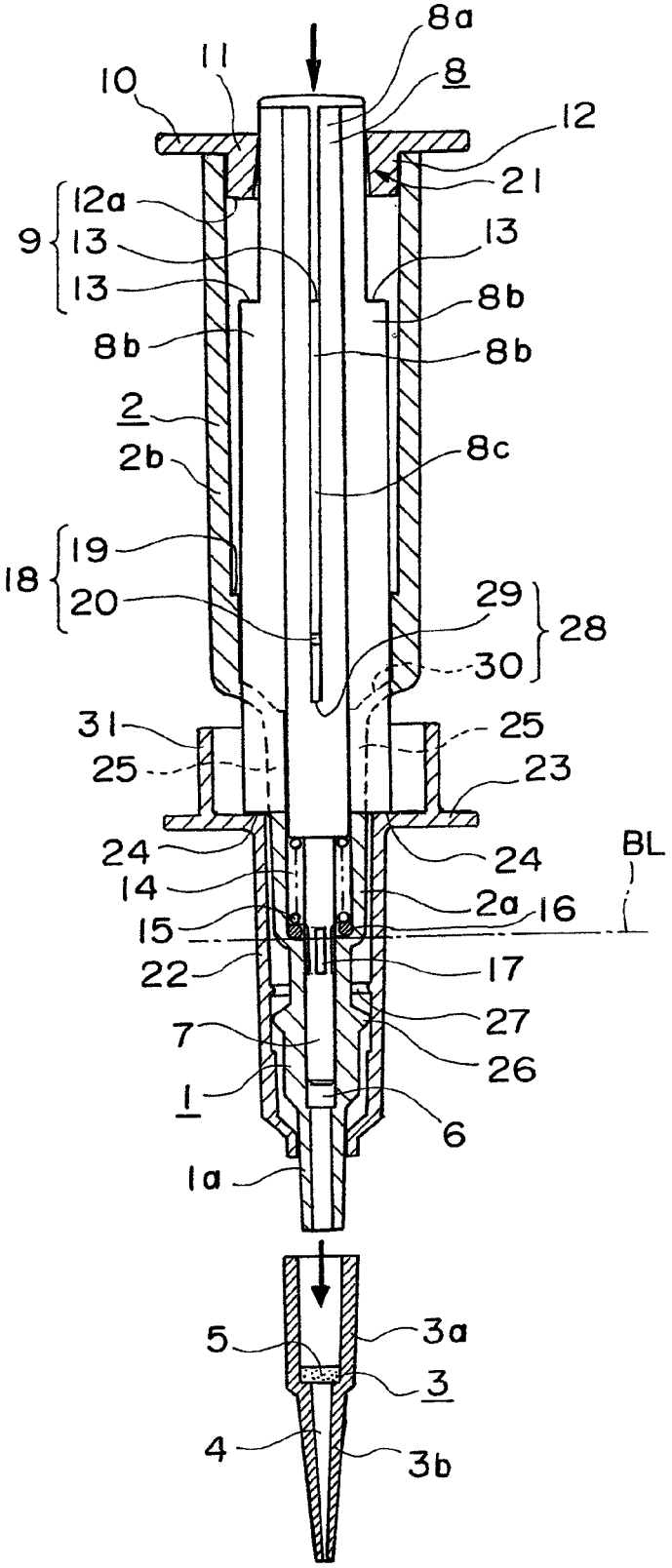
FIG. 8 An explanatory sectional view of a state in which the piston cannot be advanced any more after a pipette tip is pushed off by a release tube that has been pressed and moved in a distal end direction along with the advancement of the piston by the amount corresponding to the dimension larger than the predetermined dimension.
Figure 9:
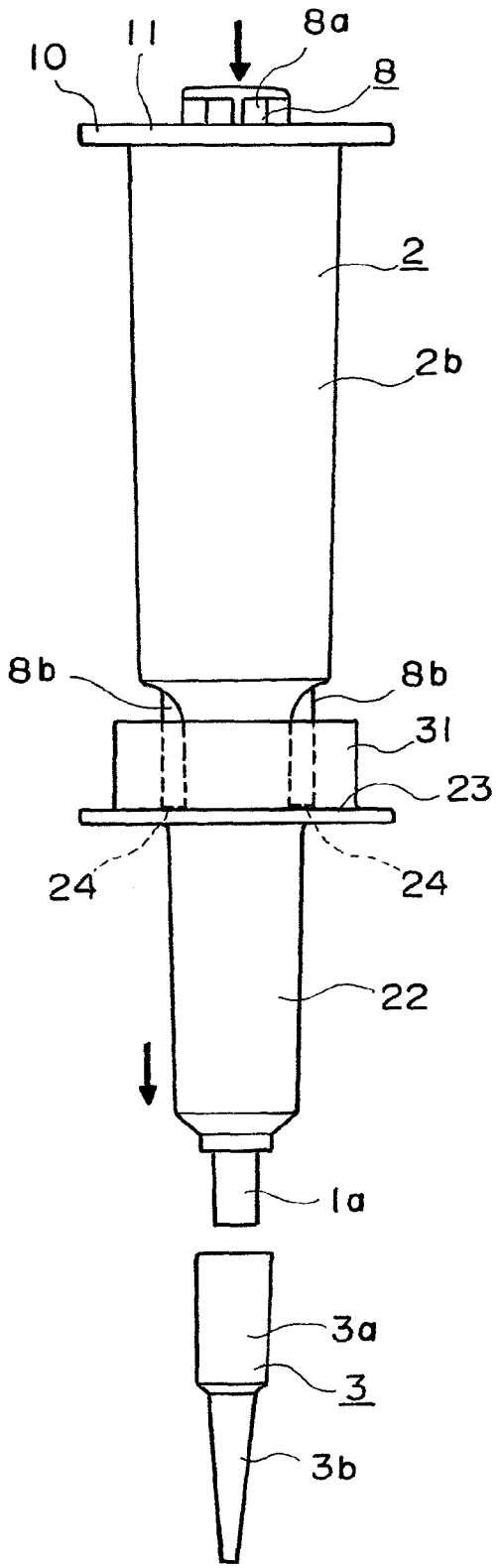
FIG. 9 An explanatory view of a state in which the pipette tip is separated from a distal end portion of the cylinder.

A position indicated by a dashed line in FIGS. 6 to 8 corresponds to a seal break line BL on which the communication grooves 17 continue to release the seal between the cylinder chamber 6 and the piston 7. When the communication grooves 17 reach the seal break line BL, the inside and the outside of the cylinder chamber 6 are communicated to each other.

Further, in this embodiment, the liquid suction amount adjusting means 21 for adjusting the retreated position of the piston 7 is provided, and hence a liquid suction amount can be easily and reliably adjusted. In this embodiment, the plug body 11 serving as the retreated position setting means 9 is utilized as the liquid suction amount adjusting means 21. In addition, the plug body 11 includes the plurality of plug bodies 11 different in length of the cylindrical portion 12 so that the plurality of plug bodies 11 thus prepared are utilized as the liquid suction amount adjusting means 21. Thus, the liquid suction amount can be adjusted by a simple operation such as replacement of the plug bodies 11.

The liquid contained in this way in the liquid containing portion 4 in the pipette tip 3 is ejected from the pipette tip 3 by pushing, into the distal end side, the proximal portion 8*a* of the operating portion 8 projected from the proximal end of the cylinder holder 2 toward the outside, and then dispensed, for example, into predetermined vessels.

In order to separate the pipette tip 3 from the distal end portion 1*a* of the cylinder 1 after dispensation of the liquid is completed, similarly to suction and ejection of the liquid, the proximal portion 8*a* of the operating portion 8 for operating the piston 7 is pushed into the cylinder holder 2 so that the piston 7 is advanced by the amount corresponding to the dimension larger than the predetermined dimension. When the piston 7 is advanced by the amount corresponding to the dimension larger than the predetermined dimension, the release portions 24 moved integrally with the operating portion 8 abut against the flange portion 23 at the proximal end of the release tube 22 so that the release tube 22 is pushed off to the distal end side. By the movement of the release tube 22 thus pushed off, the pipette tip 3 fitted to the distal end portion 1*a* of the cylinder 1 is pushed off. In this way, the pipette tip 3 can be easily separated from the distal end portion 1*a* of the cylinder 1 without being touched by hand.

This operation for separating the pipette tip 3 can be performed only by a series of strokes of the piston 7 similar to those in the operations of sucking and ejecting liquid.

Further, in this embodiment, the flange portion 23 formed at the proximal end of the release tube 22 is provided with the cylindrical guard portion 31 for surrounding the release portions 24 which are projected through the guide grooves 25 toward the outside of the cylinder holder 2 and move along the guide grooves 25 along with the movement of the piston 7. Thus, at the time of separating the pipette tip 3 from the cylinder 1, fingers of a pipette operator or gloves worn by the pipette operator can be prevented from being nipped or caught in between the release portions 24 and the flange portion 23 formed at the proximal end of the release tube 22.

Still further, the communication grooves 17 for communicating the inside and the outside of the cylinder 1 to each other when the piston 7 is advanced by the amount corresponding to the dimension larger than the predetermined dimension are provided on the outer periphery of the piston 7. Thus, when the piston 7 is advanced by the amount corresponding to the dimension larger than the predetermined dimension so that the pipette tip 3 is pushed off from the distal end portion 1*a* of the cylinder, the communication grooves 17 release the seal between the cylinder chamber 6 and the piston 7, with the result that the pressure in the cylinder chamber 6 becomes equal to the atmospheric pressure. Thus, even when liquid is left in the pipette tip 3, a situation in which the liquid scatters at the time of separating the pipette tip 3 can be prevented.

Yet further, in this embodiment, the piston 7, the bar-like operating portion 8 which is operated to advance and retreat the piston 7, and the release portions 24 which abut against the release tube 22 so that the release tube 22 is moved in the distal end direction are integrated with one another. Thus, the number of components can be saved, and a structure can be simplified. As a result, the pipette can be easily manufactured and obtained at low cost.

REFERENCE SIGNS LIST

1 cylinder
1*a* distal end portion
2 cylinder holder
2*a* small diameter cylindrical portion
2*b* large diameter cylindrical portion
3 pipette tip
3*a* proximal portion
3*b* distal end portion
4 liquid containing portion
5 filter
6 cylinder chamber
7 piston
8 operating portion
8*a* proximal portion
8*b* plate-like portion
8*c* longitudinal piece
9 retreated position setting means
10 flange portion
11 plug body
12 cylindrical portion
12*a* end portion
13 engagement portion
14 spring chamber
15 spring
16 seal ring
17 communication groove
18 position confirmation means
19 projecting step portion
20 abutment portion
21 liquid suction amount adjusting means
22 release tube
23 flange portion
24 release portion
25 guide groove
26, 27 annular projecting portion
28 advancement restricting means
29 engagement portion
30 boundary step portion
31 guard portion
32 auxiliary cylinder
BL seal break line

The invention claimed is:

1. A pipette, comprising:

a cylinder having a distal end portion to which a pipette tip is removably fitted; and a piston fitted to be freely advanced and retreated in a cylinder chamber, the piston being retreated to suck liquid and advanced to eject the liquid thus sucked, wherein the piston comprises, on an outer periphery thereof, a communication groove for communicating an inside of the cylinder chamber and an outside of the cylinder chamber to each other when the piston is advanced by an amount corresponding to a dimension larger than a predetermined dimension, the communication groove being located on the outside of the cylinder chamber when the piston is located at a retreated position.

2. A pipette according to claim 1, wherein an amount of liquid sucked in accordance with movement of the piston is set to be smaller than a capacity for the liquid in the pipette tip, the movement comprising retreat of the piston to the retreated position after advancement of the piston from the retreated position by an amount corresponding to the predetermined dimension.

3. A pipette according to claim 2, further comprising position confirmation means for notifying that the piston has been advanced by the amount corresponding to the predetermined dimension.

4. A pipette according to claim 2, further comprising liquid suction amount adjusting means for adjusting the retreated position of the piston.

5. A pipette according to claim 2, further comprising:

a release tube fitted to an outer periphery of the cylinder so as to be freely movable in an axial direction, the release tube being capable of abutting against the pipette tip fitted to the distal end portion of the cylinder by being moved in a distal end direction; and a release portion which is provided to an operating portion for operating the piston and moved integrally with the piston, wherein, after the piston is advanced by the amount corresponding to the dimension larger than the predetermined dimension, the release portion abuts against the release tube so that the release tube is moved in the distal end direction, to thereby push off the pipette tip, which is fitted to the distal end portion of the cylinder, from the cylinder through intermediation of the release tube.

6. A pipette according to claim 1, further comprising position confirmation means for notifying that the piston has been advanced by the amount corresponding to the predetermined dimension.

7. A pipette according to claim 6, further comprising liquid suction amount adjusting means for adjusting the retreated position of the piston.

8. A pipette according to claim 6, further comprising:

a release tube fitted to an outer periphery of the cylinder so as to be freely movable in an axial direction, the release tube being capable of abutting against the pipette tip fitted to the distal end portion of the cylinder by being moved in a distal end direction; and a release portion which is provided to an operating portion for operating the piston and moved integrally with the piston, wherein, after the piston is advanced by the amount corresponding to the dimension larger than the predetermined dimension, the release portion abuts against the release tube so that the release tube is moved in the distal end direction, to thereby push off the pipette tip, which is fitted to the distal end portion of the cylinder, from the cylinder through intermediation of the release tube.

9. A pipette according to claim 1, further comprising liquid suction amount adjusting means for adjusting the retreated position of the piston.

10. A pipette according to claim 9, further comprising:

a release tube fitted to an outer periphery of the cylinder so as to be freely movable in an axial direction, the release tube being capable of abutting against the pipette tip fitted to the distal end portion of the cylinder by being moved in a distal end direction; and a release portion which is provided to an operating portion for operating the piston and moved integrally with the piston, wherein, after the piston is advanced by the amount corresponding to the dimension larger than the predetermined dimension, the release portion abuts against the release tube so that the release tube is moved in the distal end direction, to thereby push off the pipette tip, which is fitted to the distal end portion of the cylinder, from the cylinder through intermediation of the release tube.

11. A pipette according to claim 1, further comprising:

a release tube fitted to an outer periphery of the cylinder so as to be freely movable in an axial direction, the release tube being capable of abutting against the pipette tip fitted to the distal end portion of the cylinder by being moved in a distal end direction; and a release portion which is provided to an operating portion for operating the piston and moved integrally with the piston, wherein, after the piston is advanced by the amount corresponding to the dimension larger than the predetermined dimension, the release portion abuts against the release tube so that the release tube is moved in the distal end direction, to thereby push off the pipette tip, which is fitted to the distal end portion of the cylinder, from the cylinder through intermediation of the release tube.

12. A pipette according to claim 11, further comprising a flange portion formed at a proximal end of the release tube so that the release portion abuts against the flange portion, wherein the flange portion comprises a cylindrical guard portion for surrounding the release portion.

13. A pipette according to claim 12, wherein the piston, the operating portion, and the release portion are integrated with one another.

14. A pipette according to claim 11, wherein the piston, the operating portion, and the release portion are integrated with one another.

* * * * *